US005325968A

United States Patent [19]

Sowden

[11] Patent Number: 5,325,968

[45] Date of Patent: Jul. 5, 1994

[54] PACKAGE FOR HOLDING TABLETS

[75] Inventor: Harry S. Sowden, Southampton, Pa.

[73] Assignee: McNeil-PPC, Inc., Milltown, N.J.

[21] Appl. No.: 92,401

[22] Filed: Jul. 14, 1993

[51] Int. Cl.[5] ..... B65D 83/04

[52] U.S. Cl. ..... 206/532; 206/534.2; 206/538; 206/820

[58] Field of Search ..... 206/528, 531, 532, 534.1, 206/534.2, 538, 820, 484, 469

[56] References Cited

U.S. PATENT DOCUMENTS

| | | | |
|---|---|---|---|
| 3,835,995 | 9/1974 | Haines . | |
| 3,921,805 | 11/1975 | Compere | 206/820 X |
| 3,933,245 | 1/1976 | Mullen | 206/532 |
| 3,941,248 | 3/1976 | Moses et al. | 206/532 X |
| 4,011,949 | 3/1977 | Brabes et al. | 206/532 |
| 4,231,477 | 11/1980 | De Felice | 206/532 |
| 4,243,144 | 1/1981 | Margulies | 206/532 |
| 4,305,502 | 12/1981 | Gregory et al. | 206/532 |
| 4,506,789 | 3/1985 | Diugosz | 206/532 |
| 4,537,312 | 8/1985 | Intini | 206/484 |
| 5,046,618 | 9/1991 | Wood | 206/532 |

*Primary Examiner*—Jacob K. Ackun, Jr.
*Attorney, Agent, or Firm*—Paul A. Coletti

[57] ABSTRACT

A limited entry unit dosage package is provided, which mandates the completion of a sequence of steps to access single unit dosages within depressions on the package. The user grips a trapezoidal section of an access tab to expose a finger depression. The user thereafter grips a cover overlying a depression which contains the unit dosage form. This cover is pulled back thereby exposing the unit dosage. This unit dosage is sealed from access by children, as well as sealed from air and liquids.

10 Claims, 5 Drawing Sheets

PACKAGE FOR HOLDING TABLETS

BACKGROUND OF THE INVENTION

The present invention relates generally to packaging of unit-dosage drug formulations, and more particularly in providing a package that both satisfies the U.S. Poison Prevention Packaging Act regarding child-resistance, and provides a safe, sturdy, and economical package for the transport and dispensing of drug formulations.

Recent Federal legislation has been enacted requiring manufacturers to provide child-resistant packaging. The U.S. Poison Prevention Packaging Act was enacted to safeguard children from self-administering pharmaceuticals that may pose a danger to them. The marketplace contains many children's formulations that are made to be palatable, but with the unfortunate side-effect that this predisposes children to believing that any pills or liquids in bottles will taste good, and do not present a danger.

It is desirable to provide a package form that is both easy to use for adults, protective for the pharmaceutical within, and difficult for children to open. The package of the present invention is easy to open for an adult, access being facilitated by entry at discrete points, with many steps necessary to access the drug form within. This method of access is both obvious to an adult, yet inhibitory to a child. The material forming the blister package is sufficiently strong such that even an adult would have great difficulty in tearing it without utilizing the prearranged scheme for tearing across the perforated score lines. The blister package is sturdy enough for fragile drug forms, provides protection from physical stresses, and is also moisture resistant. These considerations are important for pharmaceuticals formed by lyophilization, or "freeze-drying". The dosage form may be a capsule, tablet, Gelcap TM capsule or the like. The invention is also comprised of a water-tight lidding sheet, which must be peeled back to expose the dosage form within. Access to the fragile drug forms is inhibited to children by allowing for only limited entry points on the blister package, combined with sequential performance of a number of steps to obtain access to a single dosage form.

SUMMARY OF THE INVENTION

The present invention relates to a child-resistant package strong enough to protect fragile dosage unit against damage and moisture, convenient for individual dosage unit transport, and of limited access, thereby inhibiting opening of the package by children. It is therefore an object of the present invention to provide a package that offers protection against transportation damage for pharmaceutical formulations and moisture ingress by providing a strong, tear-resistant package, sealed with a lidding sheet that must be removed to access the unit dosage form within.

A further object of the present invention to provide a package that is portable and easy to use by the adult consumer by allowing individual unit dosage forms to be readily separated from the main sheet and opened, while providing difficult ingress to the dosage forms for children, such a package being easily transported by the consumer.

Another object of the present invention is to provide a package that meets the requirements of the U.S. Poison Prevention Packaging Act of 1970 for child resistance by providing a multi-step means of access to a tear-resistant package, the number of access points being limited.

The present invention comprises a package for holding a number of tablets which is made of a sheet containing multiple depressions arranged linearly thereon. Each depression is adapted to hold at least one dosage form, generally one tablet. There is contained along the blister sheet a number of weakening perforations, so that an individual dosage form may be obtained by tearing the sheet along the perforations. A cover seals the sheet around each of the depressions. The cover is divided into discrete subdivisions, generally along the perforations, so that each generally rectangular subdivision has a predetermined width and length. The cover is adhered to the blister sheet so that the cover seals the depressions from air and liquids.

Formed along the blister sheet there are contained a number of access tabs, arranged one per depression. These access tabs are maintained in spaced apart relationship to the depressions. The access tabs abut the cover. The access tabs have a width equal to the maximum width of the cover and a length which varies along the width of the cover so that the access tab contains two sections, one generally rectangular in shape and the other generally trapezoidal in shape. The generally trapezoidal portion is not sealed to the blister sheet, so that the generally trapezoidal portion forms a finger tab which is able to be gripped by the user. The rectangular portion is sealed to the blister sheet, and the rectangular portion and a portion of the cover conceals a finger depression.

When the access tab is removed, the finger depression is exposed. At that point the user is able to grip the cover and pull it off at the finger depression, so that the dosage form is thereby exposed. This multiple step arrangement causes the package to be appropriately child resistant, and yet maintains the dosage form in a unique and heretofore non-described container.

Other objects and advantages of the present invention will be made more apparent in the following detailed description of the invention.

DESCRIPTION OF THE DRAWINGS

There is shown in the attached drawings, two embodiments of the present invention, wherein like numerals in the various views refer to like elements and wherein.

DETAILED DESCRIPTION OF THE PREFERRED EMBODIMENT

Figure 3:
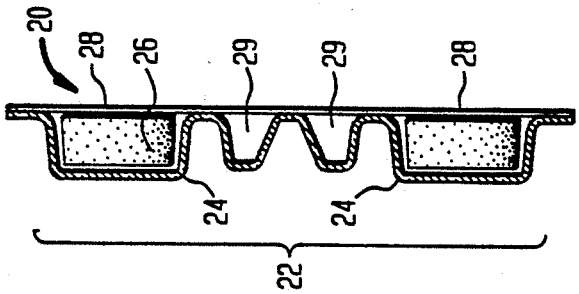
FIG. 3 is a view similar to FIG. 2, but taken along lines 3—3 of FIG. 1.
Figure 1:
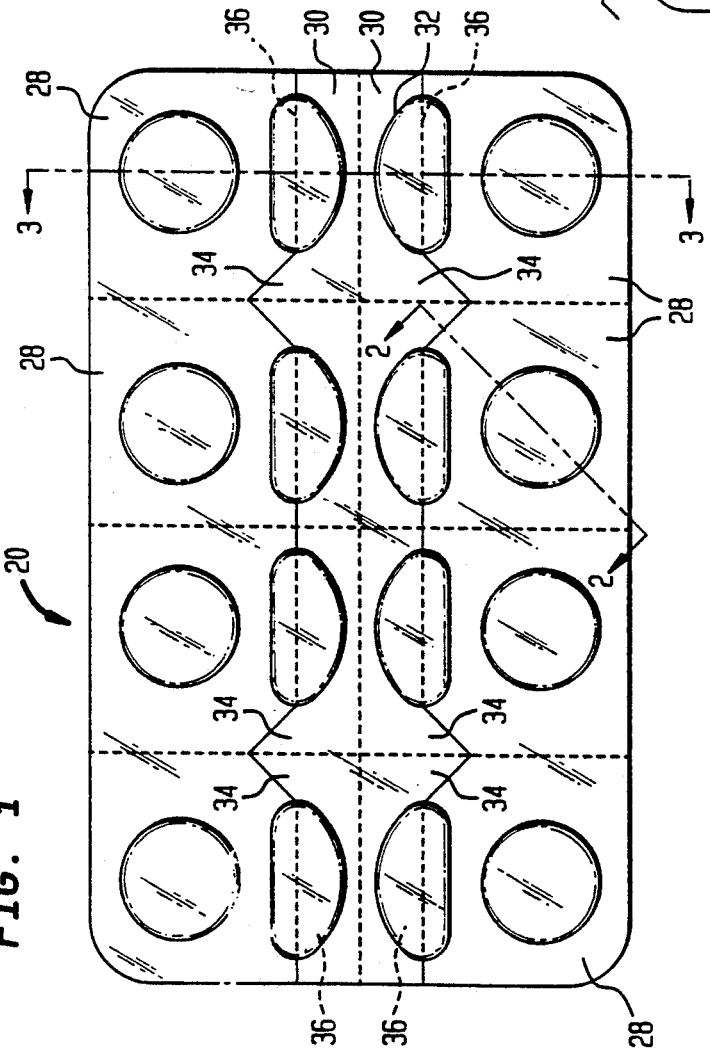
FIG. 1 is a plan view of a first embodiment of the present package invention containing multiple single-dosage units.
Figure 2:
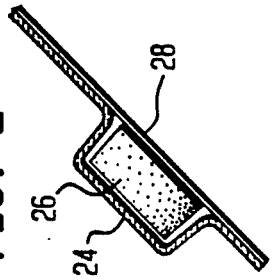
FIG. 2 is a transverse cross sectional view of said blister pack, taken generally along the line 2—2 of FIG. 1.

FIGS. 1-9 show a preferred embodiment of the present invention—a single-entry, child resistant blister package 20. FIG. 1 depicts an 8-unit blister package, although as shown herein, any commercially practicable number of units may be grouped in a single blister package. FIGS. 2 and 3 are cross sectional views of portions of a single unit dosage package as contained in FIG. 1. FIGS. 4-9 shown various steps in the opening of the blister package 20 of the present invention.

As seen by the figures, a blister package 20 contains a sheet 22 having a number of depressions 24 extending from the plane of the sheet 22. The sheet 22 can be made of any translucent, transparent or opaque plastic such as polyvinyl chloride, polyvinyl dichloride, or polyvinyl ethylene or polypropylene. Within each depression 24 is contained a tablet 26 or any other useful single unit dosage for administering to a patient. The conventional dosages may be such forms as capsules, tablets, etc. The depressions are generally circular in shape, but it is understood that the depressions 24 may also be any conventional shapes such as rectangular, ovoid capsule-shaped and the like.

The unit dosage form tablets are retained within depressions 24 by a cover 28. The cover 28 is generally formed of a laminate, such as aluminum foil, aluminum/ester laminates or any other laminated sheet generally known in the art. As is readily seen from FIGS. 1-4, the cover 28 is generally rectangular shape and for each unit dosage 27 thereby discloses a width (W) and a length (L), as better seen in FIG. 4. Contained between film sheet 22 and cover 28 there is an adhesive layer 29. This is better seen in FIG. 3. This adhesive layer causes the cover 28 to be heat sealed to the blister sheet 22 so that the depressions 24 are readily sealed from the atmosphere, including from air and liquids.

Extending from one side of the blister sheet 22 is an access tab 30 formed by perforations. This access tab 30 is also sealed to the blister sheet 22. This access sheet 30 contains a generally rectangular portion 32 and a generally trapezoidal portion 34. The generally trapezoidal portion 34 is exposed, that is, not sealed to the blister sheet 20. On the other hand, the rectangular portion 32 is sealed to the blister sheet along a portion of the blister sheet 22. The rectangular portion covers a portion of the finger depression 36. This finger depression is generally oval in shape and will be useful for gaining access to the central depression 24.

Figure 4:
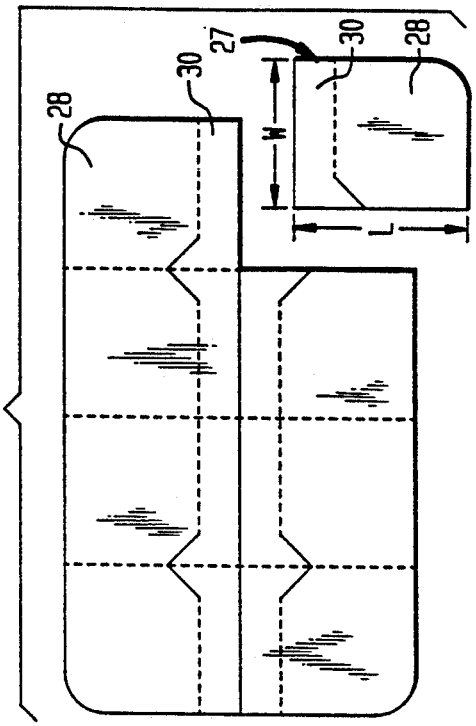
FIG. 4 is a plan view of the package of FIG. 1, illustrating a first tearing across a perforated score line to permit access to a single dosage unit.
Figure 6:
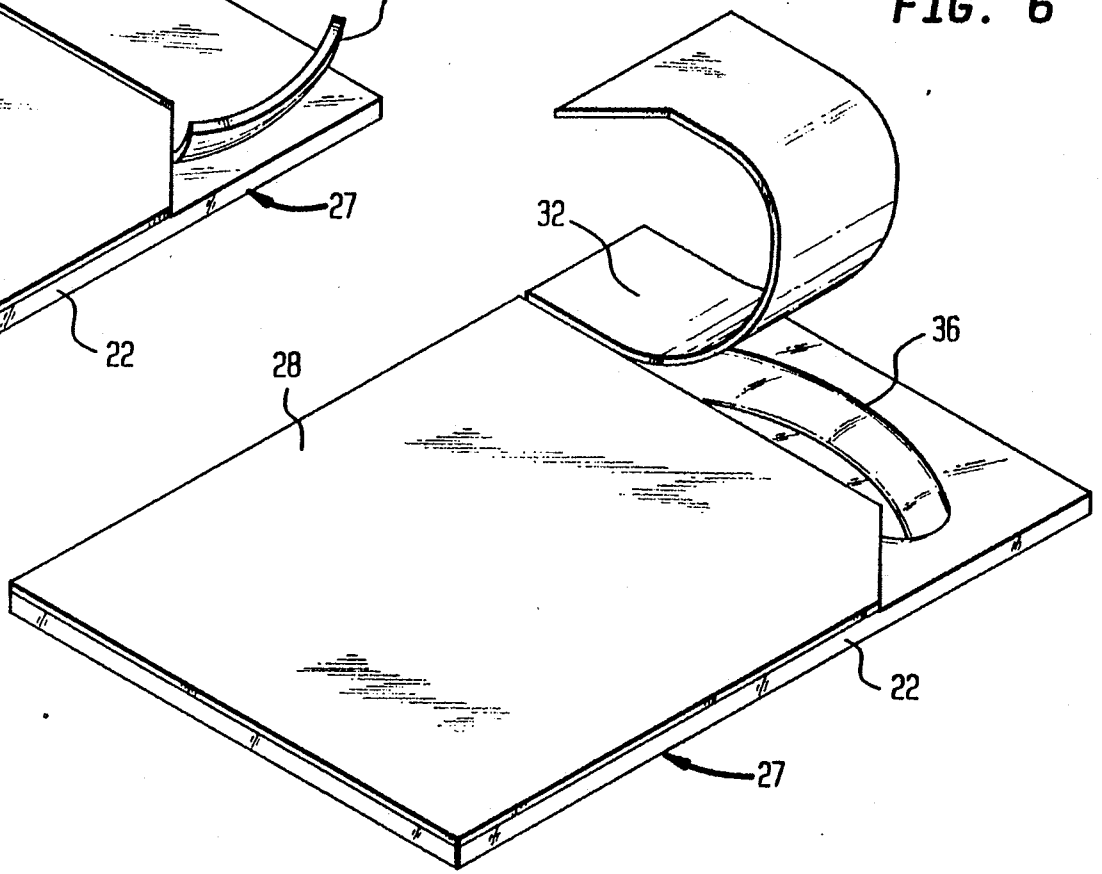
FIGS. 5, 6, 7, 8 and 9 show step by step views of the opening of a single unit dosage container.
Figure 5:
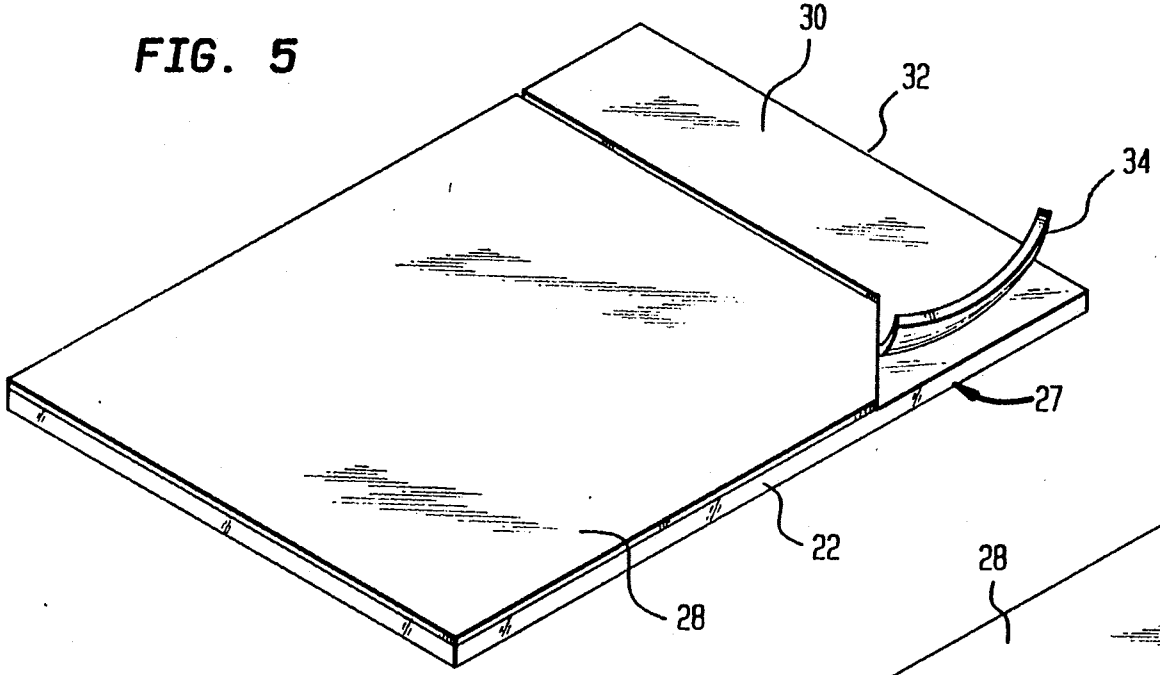
Figure 7:
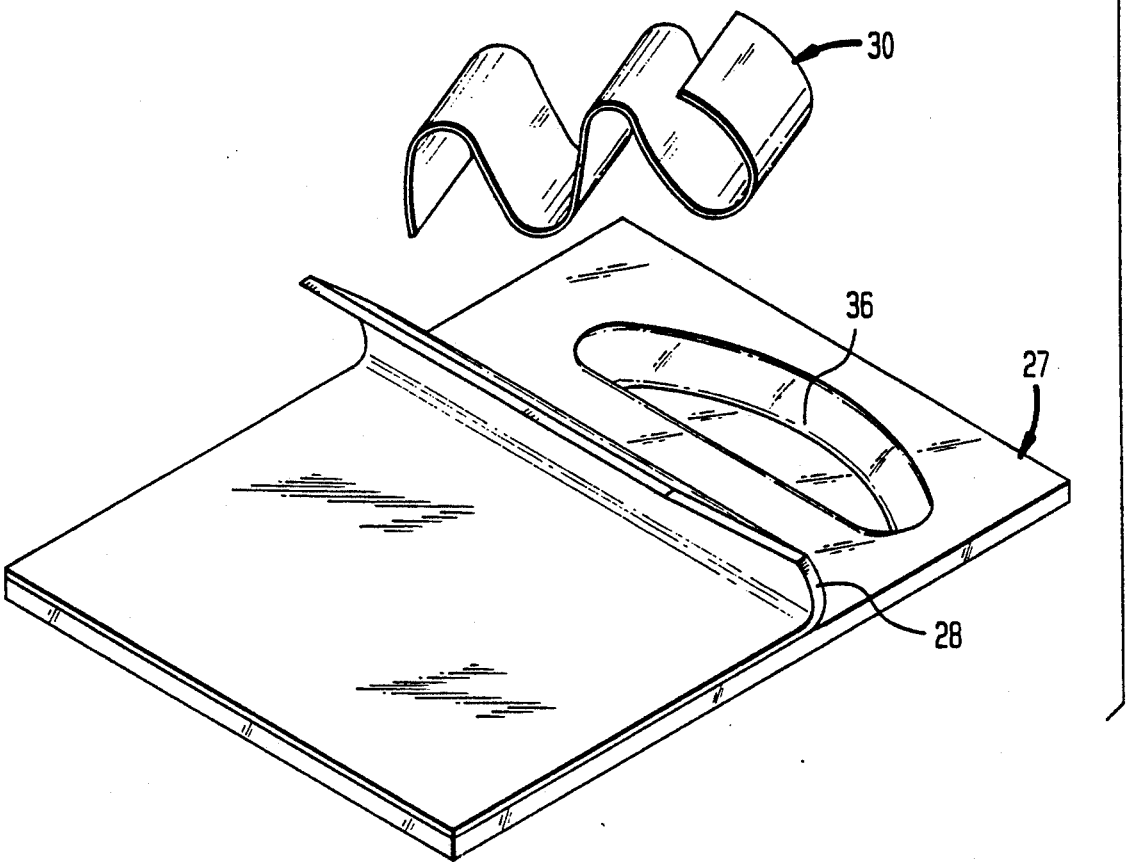
Figure 8:
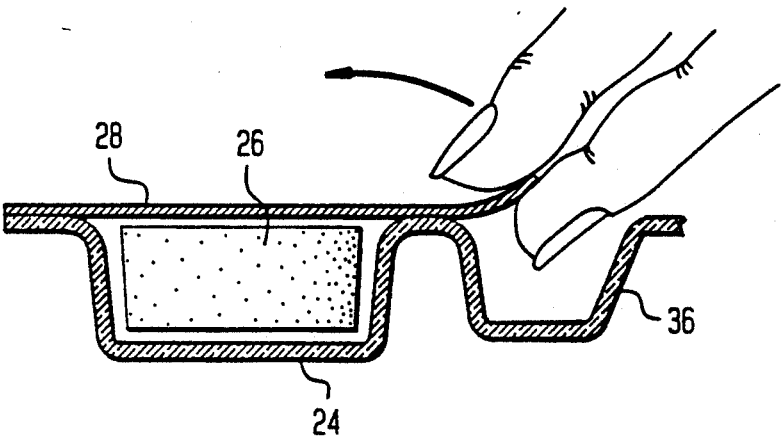
Figure 9:
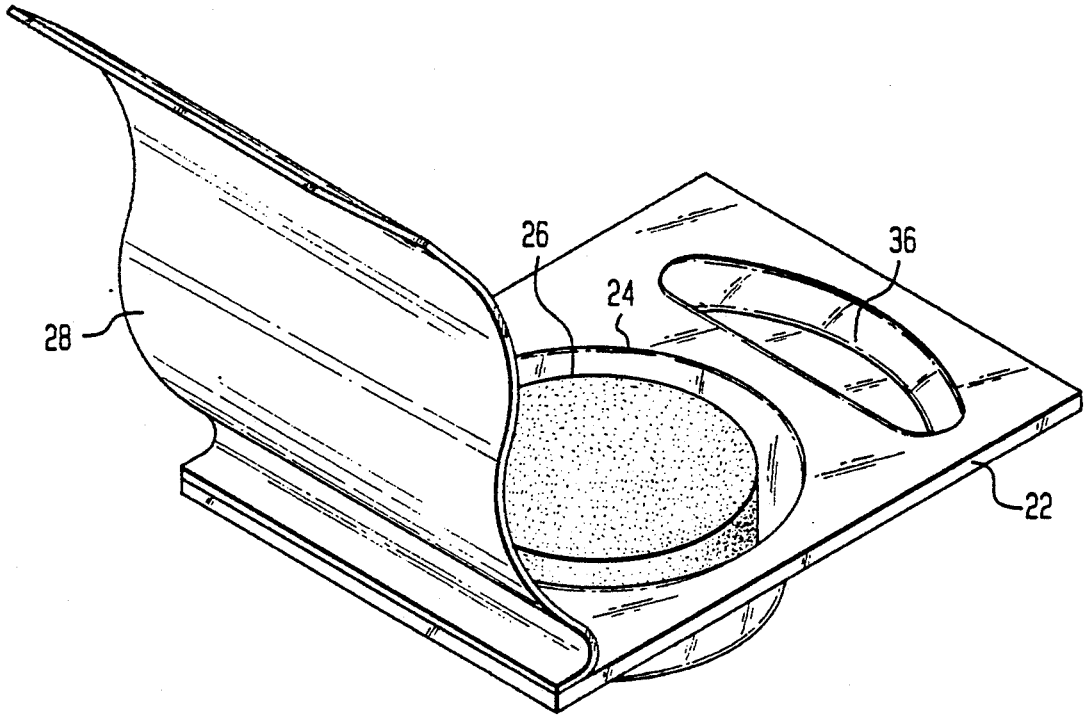

Therefore, as seen in FIGS. 5-9, access to the central portion to obtaining unit dosages is as follows:

First, a single-unit dosage section 27 of the blister package 20 is obtained by tearing the blister sheet along the generally perpendicular score lines in the blister sheet so that one portion 27 of the unit dosage package is obtained, as better seen in FIGS. 4 and 5. This exposes the generally trapezoidal portion 34 of the access tab 30. The user grips the access tab at the generally trapezoidal portion 34. The trapezoidal portion 34 is configured so that the access tab is large enough to be gripped by the thumb, something which is heretofore been very difficult for the user. Thereafter, the user pulls back the access 30 tab along the heat sealed rectangular portion 32 (FIG. 6). The finger depression 36 is now exposed as is better seen in FIGS. 6 and 7. As better seen in FIGS. 7 and 8, with the finger depression 36 exposed, the user can place a finger into the depression 36 and grip the portion of the cover 28 which seals the unit dosage form. Thereafter the user pulls the cover 28 so that the unit dosage form 26 contained in the depression 24 is exposed.

Figure 10:
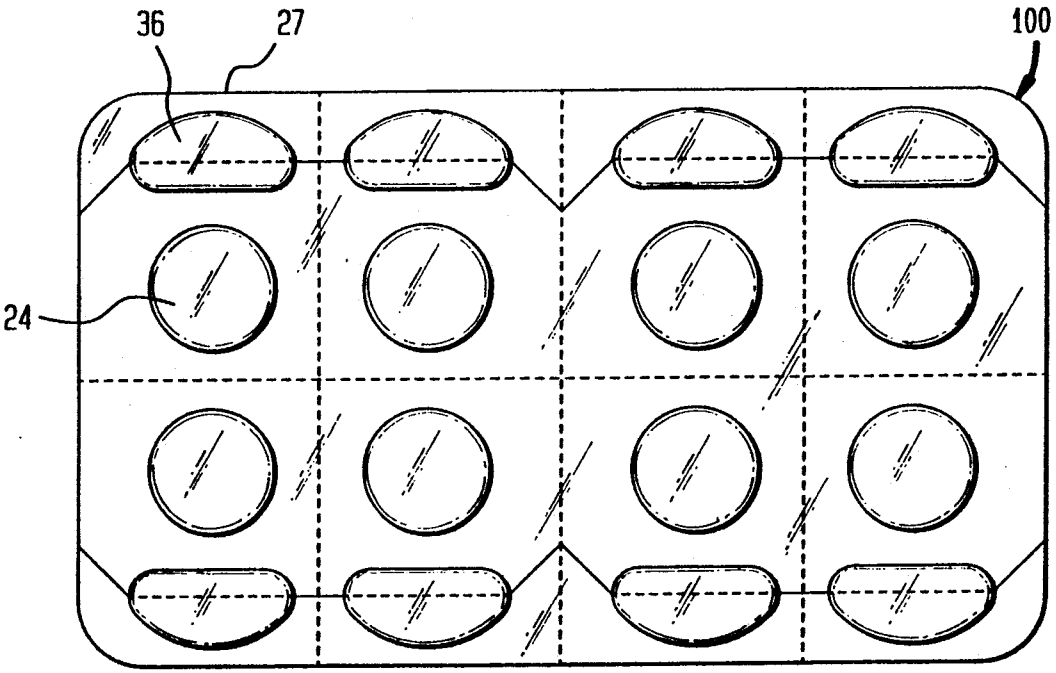
FIG. 10 is a plan view of a second embodiment of this invention.

Alternately, as seen in FIG. 10, there is contained a second embodiment 100 of this invention. As better seen therein, the unit dosage forms 27 are arranged so that the finger depressions 36 are now on the outside of the blister package, that is not at the intersection of the two rows R of unit dosage forms. This configuration allows the user to maintain all of the unit dosage forms in the same package 100 without having to remove a single unit dosage form 27 from the contiguous package 100. This alternate embodiment may have some advantages in that one less step is provided to gain access to the depression 24 containing the usage dosage tablet 26.

While the present invention is disclosed herein, it is understood by the reader that the invention is not limited to only this embodiment but that any changes or modifications but that some changes in modifications may be made within the scope of this invention, which is to be limited only by the scope of the appended claims and its equivalents.

I claim:

1. A package for holding a plurality of tablets comprising:

a sheet containing a plurality of depressions, each depression capable of holding therein at least one tablet each said depression comprising a well and having a perimeter;

a cover for sealing to said sheet around the perimeter of each said depression, said sheet divided by a plurality of perforations into discrete subdivisions so that each subdivision contains one of said depressions and has a predetermined width and length;

an adhesive layer attaching said sheet to said cover around the perimeter of each of said depressions wherein said cover completely seals said depressions; and a plurality of access tabs formed in said cover by perforations, said access tabs corresponding in number to said subdivisions, each of said access tabs placed in spaced apart relation to each of said depressions, and each said access tab having a length equal to the width of said subdivision and a width which varies along said subdivision width wherein each said access tab forms a generally trapezoidal portion extending from a generally rectangular portion, and each said access tab is sealed to said sheet in the area of said rectangular portion but not sealed to said sheet in the area of said trapezoidal portion.

2. The package of claim 1 wherein a plurality of finger depressions are formed in said sheet each finger depression associated with a subdivision, and, wherein each said rectangular portion and the portion of said cover abutting each said rectangular portion form a seal about a finger depression in said sheet, so that when an access tab is removed from said sheet, a portion of said finger depression is exposed, and a portion of said cover is manipulable within said finger depression.

3. The package of claim 1 wherein said depressions which are capable of holding a tablet are circular in shape.

4. The package of claim 2 wherein said finger depressions are generally oval in shape.

5. The package of claim 2 wherein said depressions which are capable of holding tablets are arranged linearly.

6. The package of claim 5 wherein there are at least two rows of said depressions which are capable of holding a tablet arranged linearly opposite one another.

7. The package of claim 6 wherein said finger depressions face one another along said two rows.

8. The package of claim 6 wherein said finger depressions are spaced apart from one another.

9. The package of claim 1 wherein the portion of said cover overlaying said depression capable of holding a tablet is generally rectangular in shape.

10. The package of claim 1 wherein said depressions capable of holding tablets are configured as capsules to be able to hold capsule-shaped tablets.

* * * * *